United States Patent [19]

Mathes

[11] Patent Number: 4,869,166

[45] Date of Patent: Sep. 26, 1989

[54] SHEET PRESSING MEANS FOR A MULTI-COLOR SHEET-FED ROTARY PRESS

[75] Inventor: Josef Mathes, Offenbach, Fed. Rep. of Germany

[73] Assignee: MAN Roland Druckmaschinen AG, Offenbach am Main, Fed. Rep. of Germany

[21] Appl. No.: 239,535

[22] Filed: Sep. 1, 1988

[30] Foreign Application Priority Data

Sep. 11, 1987 [DE] Fed. Rep. of Germany ..... 3730484

[51] Int. Cl.[4] ..... B41F 21/10

[52] U.S. Cl. ..... 101/230; 271/195; 101/246

[58] Field of Search ..... 101/230, 231, 232, 183, 101/409, 246; 271/276, 195

[56] References Cited

U.S. PATENT DOCUMENTS

| | | | |
|---|---|---|---|
| 2,931,647 | 4/1960 | Papa et al. | 101/230 |
| 3,986,455 | 10/1976 | Jeschke et al. | 101/409 |
| 4,014,261 | 3/1977 | Becker | 101/230 |
| 4,122,773 | 10/1978 | Wirz | 101/230 |
| 4,127,265 | 11/1978 | Wirz et al. | 271/276 |
| 4,572,071 | 2/1986 | Cappel et al. | 101/183 |
| 4,579,446 | 4/1986 | Fujino et al. | 271/185 |
| 4,584,939 | 4/1986 | Giuri | 101/177 |
| 4,688,784 | 8/1987 | Wirz | 271/195 |
| 4,723,489 | 2/1988 | Emrich et al. | 101/230 |
| 4,796,529 | 1/1989 | Mathes | 101/230 |

FOREIGN PATENT DOCUMENTS

| | | | |
|---|---|---|---|
| 1561101 | 1/1970 | Fed. Rep. of Germany | 101/230 |
| 2633183 | 2/1977 | Fed. Rep. of Germany | 101/230 |
| 2807151 | 8/1979 | Fed. Rep. of Germany | 101/230 |
| 3643915 | 10/1987 | Fed. Rep. of Germany | 101/230 |

*Primary Examiner*—Eugene H. Eickholt

*Attorney, Agent, or Firm*—D. R. Schlemmer

[57] ABSTRACT

Sheet pressing means for a multi-color sheet-fed press adapted for both first-side printing and perfecting printing wherein the press includes a press frame and first and second impression cylinders with a sheet-turning cylinder therebetween. The sheet pressing means includes a plurality of hollow air-blowing fingers disposed after the printing zone of the first impression cylinder for directing blown air to press a sheet onto the surface of the first impression cylinder, with the fingers being disposed in substantially equidistant relationship to one another on a support tube which is disposed above the first impression cylinder and substantially parallel to the axis thereof along substantially the entire length of the first impression cylinder. Preferably, the fingers each have at the downstream end thereof an air exit surface with air exit orifices formed therein, and the exit surfaces are formed to conform generally to the convex external contour of the first impression cylinder and have a downstream tip end adapted to be positioned closely adjacent the point of tangency between the first impression cylinder and the sheet-turning cylinder. In the preferred embodiment, an articulated linkage is mounted on the press frame for selectively moving the support tube, the fingers and the tip ends thereof toward said point of tangency for perfecting printing and away from said point of tangency for first-side printing and a valve is provided for controlling the air flow through the fingers.

8 Claims, 3 Drawing Sheets

VIEW X

SHEET PRESSING MEANS FOR A MULTI-COLOR SHEET-FED ROTARY PRESS

FIELD OF THE INVENTION

The present invention relates generally to a sheet pressing means for a multi-color sheet-fed press and more particularly concerns such a sheet pressing means for perfecting printing which may be selectively repositioned during first-side printing.

BACKGROUND OF THE INVENTION

It is known in the prior art to locate one or more blowing strips disposed with their axes parallel to one another, before or after the printing zone above an impression cylinder such that, disregarding the blowing air, the sheet is spread smoothly substantially without contact on the impression cylinder surface. Blowing means of this kind are satisfactory for first-printing. However, they cannot improve the in-register removal of a turned sheet from a previous impression cylinder by means of suckers or grippers or the like disposed on the sheet-turning cylinder and they are also unsuitable for providing a crease-free transfer of the turned sheet to the next printing unit for perfecting printing.

It is known from a number of prior publications, for the sheet to be pressed at the point of tangency on to the surface of the impression cylinder preceding the sheet-turning cylinder by mechanical means, such as guide segments disposed on the periphery of the latter cylinder (cf. DE-AS No. 2,040,712) or by inflatable air hoses (cf. JP-PA No. 58 145450). To some extent these features may provide for in-register removal of the sheet from the impression cylinder by way of the sheet rear edge and a crease-free transfer of the turned sheet to the next printing unit. However, a disadvantage of these systems is that, if no pressure-free corridors are provided, these mechanical means always blur or impair the print image.

OBJECTS AND SUMMARY OF THE INVENTION

It is therefore the primary aim of the invention to provide means in multi-color sheet-fed rotary presses for first printing and perfecting printing such that the printed sheet can be pressed without contact, in the zone before the point of tangency between a sheet-turning cylinder and the preceding impression cylinder, by the effect of flowing air on to the closed surface of the impression cylinder until the trailing sheet end is engaged by suckers or grippers or the like on the sheet-turning cylinder.

This problem is solved by providing a plurality of hollow air-blowing fingers disposed after the printing zone of the first impression cylinder for directing blown air to press a sheet onto the surface of the first impression cylinder wherein the fingers are disposed in substantially equidistant relationship to one another on a support tube which is disposed above the first impression cylinder and substantially parallel to the axis thereof along substantially the entire length of the first impression cylinder. Preferably, the fingers each have an air exit surface with air exit orifices formed therein and the exit surfaces are formed to conform generally to the convex external contour of the first impression cylinder and have a downstream tip end adapted to be positioned closely adjacent the point of tangency between the first impression cylinder and the sheet-turning cylinder. In the preferred embodiment, an articulated linkage is mounted on the press frame for selectively moving the support tube, the fingers and the tip ends thereof toward the point of tangency for perfecting printing and away from the point of tangency for first-side printing and a valve is provided for controlling the air flow through the fingers.

The advantage provided by the invention is that the effect of flowing air can be used to press a sheet on to the impression cylinder in perfecting printing as well as in first-printing, something which has not been previously possible.

These and other features and advantages of the invention will be more readily apparent upon reading the following description of a preferred exemplified embodiment of the invention and upon reference to the accompanying drawings wherein:

While the invention will be described and disclosed in connection with certain preferred embodiments and procedures, it is not intended to limit the invention to those specific embodiments. Rather it is intended to cover all such alternative embodiments and modifications as fall within the spirit and scope of the invention.

DETAILED DESCRIPTION OF THE PREFERRED EMBODIMENTS

Figure 1:
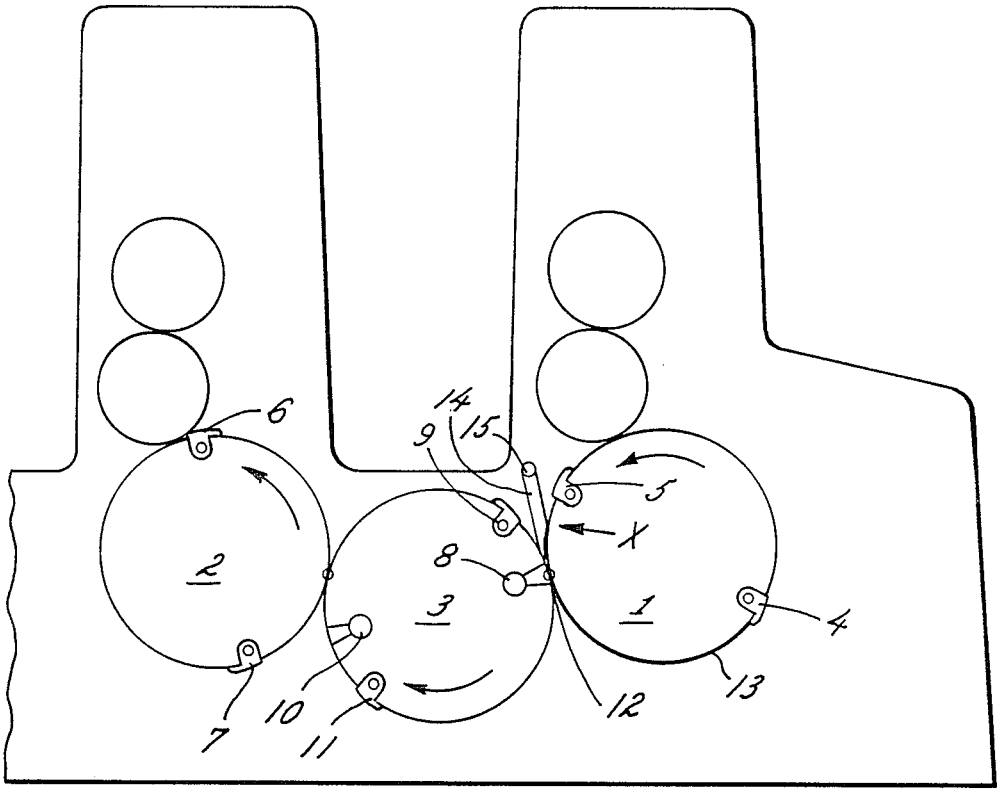
FIG. 1 is a diagrammatic view in side elevation of a sheet-turning device of a multi-color rotary press adapted for both first-side printing and perfecting printing.

Turning now to the drawings, there is shown in FIG. 1, a schematic view of a multi-color, sheet-fed rotary printing press that may be selectively operated for either first-side printing or perfecting printing. The press includes a first impression cylinder 1 and a second impression cylinder 2 and also includes conventional sheet delivery and sheet take away mechanisms which are not shown here.

In the illustrated embodiment, a sheet-turning cylinder 3 is disposed between the first impression cylinder 1 and the second impression cylinder 2 of consecutive printing units in the press. It will be understood that the diameter of cylinder 3 is equal to the diameter of the cylinders 1, 2 and is twice the diameter of the other press cylinders. Two stationary and diametrically opposite sheet gripper systems 4, 5, 6, 7 are disposed on each cylinder 1, 2. Similarly, two sucker systems 8, 10 and two gripper systems 9, 11 are disposed diametrically opposite one another on the sheet-turning cylinder 3, and as is conventional, the systems 8–11 are each disposed on a shaft mounted rotatably and eccentrically of the axis of cylinder 3.

FIG. 1 also shows how the sheet 13 lies on the closed surface of the first impression cylinder 1. Thus, the grippers of system 4 have guided the front edge of sheet 13 beyond point 12 of tangency between the first impression cylinder 1 and the sheet-turning cylinder 2 and the sheet trailing end has reached the point 12. Immediately before or at the point 12, the suckers 16 of the system 8 remove the sheet trailing end from the surface of cylinder 1 by suction and the grippers of system 4 of cylinder 1 release the leading end of sheet 13.

As the cylinders 1–3 continue to rotate, the systems 8, 9 are swung towards the center of the cylinder 3 and towards one another in known manner and the grippers of system 9 take over the sheet 13. Upon completion of the transfer the two systems 8, 9 return in known manner to their respective initial positions.

As will be understood by those skilled in the art, the sheet 13 has therefore been turned and is now guided by the gripper system 9, by way of its (former) rear edge, to the next point of tangency, where the sheet 13 is transferred from system 9 to system 6 of cylinder 2. System 6 supplies the turned sheet 13 to the next printing unit where the back of sheet 13 is to be printed. The next sheet following the sheet 13 in sequence is guided through the press in the same way by the corresponding sheet-guiding systems ii i.e., the system 5 on cylinder 1, the systems 10, 11 on the cylinder 3 and the system 7 on the cylinder 2—which are disposed diametrically opposite the systems described.

When the press is changed over so that the gripper system 9-11 takes over the sheet 13 by way of its front end from the gripper system 4, 5 of the previous impression cylinder 1, the sheet 13 is so guided by the system 9, 11 between the consecutive printing units as to be printed on the same side in both units (first-side printing). The swinging movement of the systems 8, 10 and 9, 11 is rendered inoperative in this case. Thus, during the rotation of the cylinder 3, the systems 8, 10 and systems 9, 11 remain in their swung-out position.

To press the sheet 13 without physical contact, by means of blown air, on to the surface of the first impression cylinder 1 directly as far as the transfer zone at the tangency point 12, means are provided which have a blowing finger support tube 15, the same extending above the impression cylinder 1 parallel to the axis thereof and over the whole length of the cylinder 1. Spaced-apart blowing fingers 14 are so disposed on tube 15 as to co-rotate therewith and extend by way of their bottom zone having air exit surfaces 18 with air exit orifices 17 formed therein and with the finger tips positionable in the transfer zone closely adjacent the tangency point 12 between the suckers 16 of the gripper systems 8, 10. Surface 18 is formed to correspond substantially to the generally convex contour of the impression cylinder 1 to ensure a constant gap width.

Figure 4:
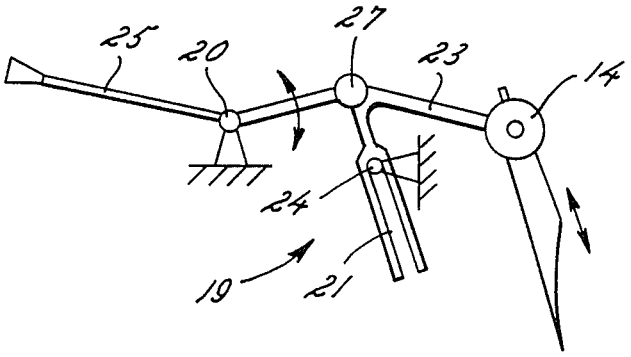

In first-side printing, the sheet pressing means according to the invention are raised by means of an adjuster 19 from adjacent the transfer zone and the sheet pressing means can be lowered back by the same means for perfecting printing. The associated linkage is diagrammatically shown in FIG. 4. According to the illustrated embodiment (FIGS. 2 and 4), the adjuster 19 has one bent support stirrup 23 having one arm secured to the end of the tube 15. The other arm of stirrup 23 is fashioned with a slotted cam 24 which slides on a pin 21 rigidly secured to the press frame. Also, a manual control lever 25 having a pin 20 rigidly secured to the press frame is articulated by means of an articulation 27 at the apex of stirrup 23.

Figure 2:
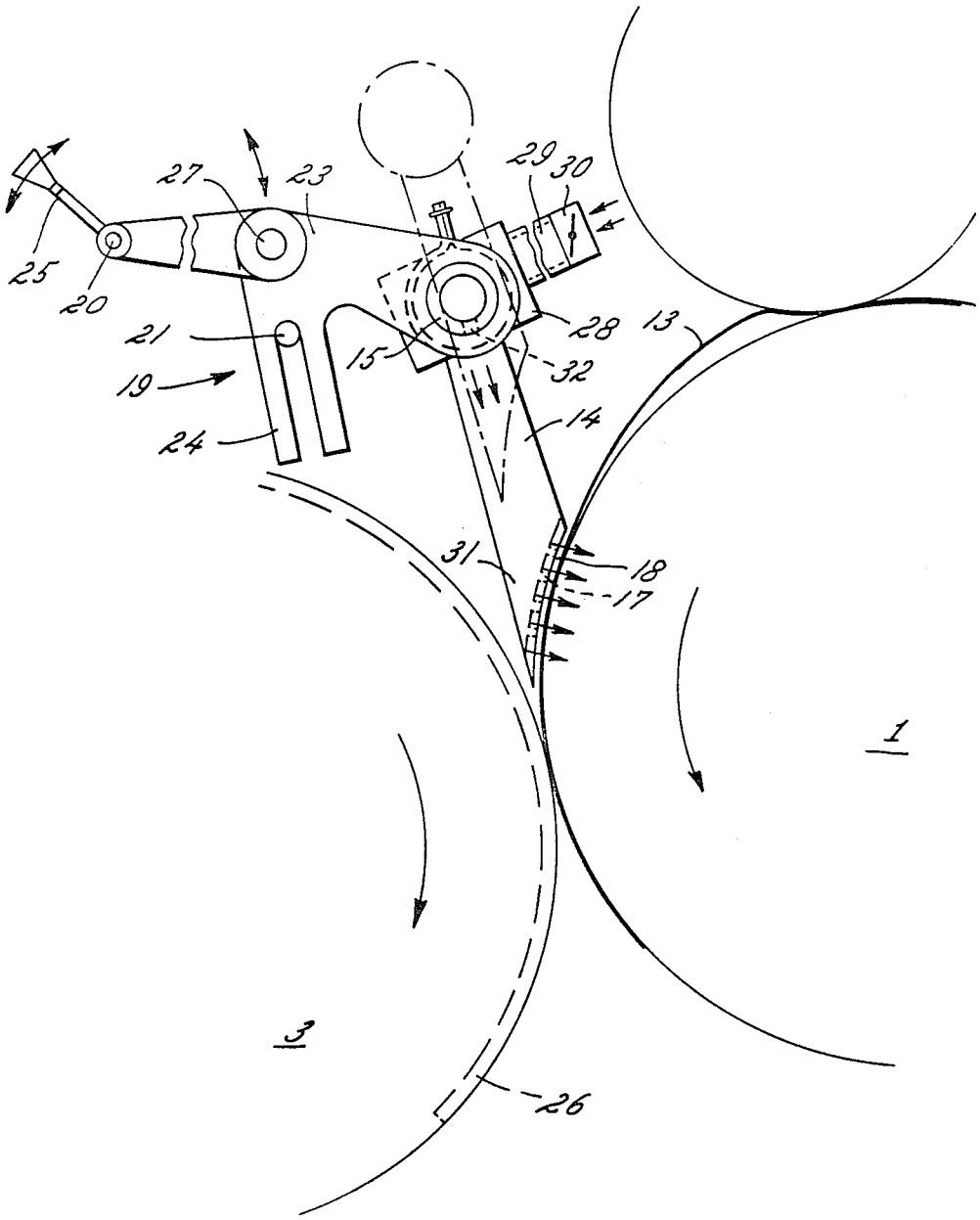
FIG. 2 is an enlarged, fragmentary view in side elevation of the sheet pressing means according to the invention.

When the lever 25 is pivoted anticlockwise around the pin 20, the means can be raised from the operative position for perfecting, together with the fingers 14, into the dash-line position 14′ shown in FIG. 2 for first-side printing. The cam slot 24 and pin 21 are operative to superimpose the thrust movement upon the circular pivoting movement of the lever 25. When the lever 25 is pivoted back clockwise, the sheet pressing means according to the invention are lowered into the position for perfecting printing into the transfer zone closely adjacent to the tangency point 12.

Figure 3:
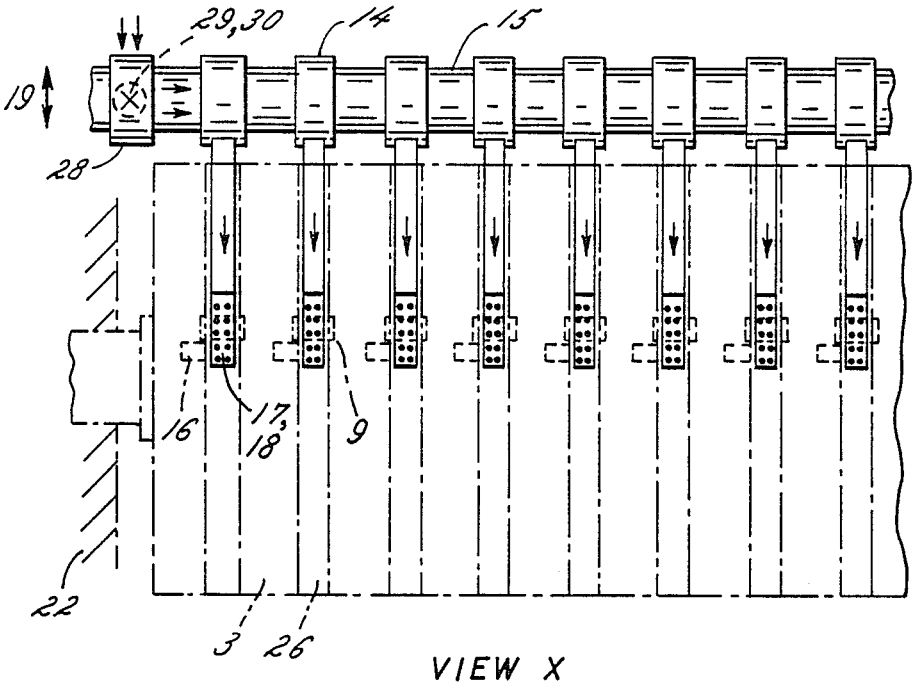
FIG. 3 is an enlarged, fragmentary and partly diagrammatic view of a portion of FIG. 1, substantially as seen in the direction of arrow X in FIG. 1; and, FIG. 4 is a further enlarged, fragmentary view in side elevation of the coupling linkage for lifting and lowering the sheet pressing means relative to the transfer zone (point of tangency) in the printing press.

The airflow, indicated by arrows in FIGS. 2 and 3, is supplied through an air supply tube 29 to a block 28 disposed on tube 15. The latter is formed with an orifice so that the infed air flow can enter the tube 15 and continue through passages 32 into hollow interior 31 of the fingers 14. Preferably, the quantity of flowing air is adjustable, for example, by an upstream control valve (not shown) or by a butterfly valve 30 interposed in the tube 29.

To ensure that the airflow is effectively directed, dependent upon sheet length and format, only near the beginning and end of the sheet 13, two cams (not shown) peripherally adjustable relative to one another may be disposed on a single-revolution shaft and in known manner cooperate with a control valve adapted to release the air flow during the required interval.

In the preferred embodiment, the cylinder 3 is also formed on its periphery with circumferential recesses 26 distributed uniformly over the cylinder width, to obviate any interference with the tips of the fingers 14 in the perfecting printing position. Also, if the fingers 14 are to be disposed opposite the systems 9, 11, the same must be swung in towards the center of the cylinder 3 in good time during the rotation of the cylinder in order to obviate any collision with the fingers 14 during perfecting printing—i.e., in the operative position. This can be achieved in known manner by prolonging the corresponding camming part of the cam. It will be understood that there can be no interference with the fingers 14 in first-printing since, in this case, the sheet pressing means must first be raised by the adjuster 19 out of the transfer zone.

We claim as our invention:

1. Sheet pressing means for a multi-color sheet-fed press adapted for both first-side printing and perfecting printing wherein said press includes a press frame and first and second impression cylinders with a sheet-turning cylinder therebetween, comprising, in combination, means including a plurality of hollow air-blowing fingers disposed after the printing zone of said first impression cylinder for directing blown air to press a sheet onto the surface of said first impression cylinder, said fingers being disposed in substantially equidistant relationship to one another on a support tube which is disposed above said first impression cylinder and substantially parallel to the axis thereof along substantially the entire length of said first impression cylinder, said fingers each having at the downstream end thereof an air exit surface with air exit orifices formed therein, said air exit surface being formed to conform generally to the convex external contour of said first impression cylinder and having a downstream tip end adapted to be positioned closely adjacent the point of tangency between said first impression cylinder and said sheet-turning cylinder, and means mounted on said press frame for selectively moving said support tube, said fingers and the tip ends thereof toward said point of tangency for perfecting printing and away from said point of tangency for first-side printing.

2. Sheet pressing means as defined in claim 1, wherein the air flow to said air-blowing fingers is controlled by upstream valve means.

3. Sheet pressing means as defined in claim 2 wherein said valve means is coupled to said press for operation in timed sequence with the travel of said sheets on said first impression cylinder.

4. Sheet pressing means as defined in claim 3 including adjusting means for said valve means for controlling the air flow in relation to the length of said sheets so as to flow air only from the start to the end of each of said sheets.

5. Sheet pressing means as defined in claim 1 wherein said selective moving means includes an articulated lever linkage for moving said fingers toward and away from said point of tangency.

6. Sheet pressing means as defined in claim 5 wherein movement of said articulated lever is guided by a cam slot and pin connection one of which is mounted on said press frame.

7. Sheet pressing means as defined in claim 1 wherein said support tube and said fingers are movably mounted on said press frame by means including a bent-end support stirrup connected to an articulated lever linkage.

8. Sheet pressing means as defined in claim 1 wherein said support tube is a hollow supply tube communicating with the hollow interior of said airblowing fingers and the air flow to said fingers is adjustably controlled by valve means upstream of said support tube.

* * * * *